United States Patent [19]

Bruno

[11] Patent Number: 4,503,561

[45] Date of Patent: Mar. 5, 1985

[54] BAG FOR PACKAGED PRODUCE

[76] Inventor: Edward C. Bruno, 1880 S. Monaco Pkwy., Denver, Colo. 81016

[21] Appl. No.: 522,499

[22] Filed: Aug. 12, 1983

[51] Int. Cl.[3] ..... B65D 33/04

[52] U.S. Cl. ..... 383/102; 383/103; 383/117; 383/118

[58] Field of Search ..... 383/102, 103, 117, 118

[56] References Cited

U.S. PATENT DOCUMENTS 3,040,966 6/1962 Crane ..... 383/103

3,245,606 4/1966 Crane ..... 383/103

3,603,369 9/1971 Scholz ..... 383/118 X 3,655,501 4/1972 Tesch ..... 206/813 X

*Primary Examiner*—Allan N. Shoap

*Assistant Examiner*—Bryon Gehman

*Attorney, Agent, or Firm*—Leo J. Aubel; Ralph R. Rath

[57] ABSTRACT

A bag made of thin pliable plastic film, including panels having slits formed therein, the slits of the bag being formed to extend in a first direction, and the slits on a relatively facing panel having slits formed to extend in a direction transverse to said first direction.

4 Claims, 5 Drawing Figures

BAG FOR PACKAGED PRODUCE

TECHNICAL FIELD OF THE INVENTION

The present invention relates to produce bags formed of plastic and adapted to provide ventilation to the produce contained in the bag.

BACKGROUND OF THE INVENTION

This invention relates generally to bags made from a sheet of thin pliable plastic, particularly for packaging produce such as grapes. Such prior art bags are slit for the purpose of allowing air to circulate into the bag for ventilation of the produce packed therein, and also to enable ready expansion and conformity to the produce.

The present invention is an improvement over the prior art, such as shown, for example, in U.S. Pat. No. 3,245,606, now expired. U.S. Pat. No. 3,245,606 shows a bag of the type described herein and having two facing panels or walls. One panel has slits therein and the other panel is solid; that is, there are no slits in said other panel. The slits in the one panel are formed in parallel rows and with the slits in each row being longitudinally spaced from one another. The slits in alternate rows are aligned in a direction transversely of the slits; and the slits in adjacent rows are offset from one another. The slits in the panel enable the panel to stretch to conform closely to the contained produce and to permit the ventilation of the produce. The unslitted panel functions to limit the stretching of the slitted panel as well as the stretching of the overall bag, all as is described in detail in said prior art.

A principal purpose of the present invention is to improve structure of bags such as disclosed in said U.S. Pat. No. 3,245,606 to provide a strong bag, utilizing of the same type of plastic sheet or film, while permitting maximum ventilation to all the produce in the bag.

SUMMARY OF THE INVENTION

The invention discloses a bag for packing produce, such as berries, grapes, and the like. The inventive bag is formed to have two facing or opposite panels of pliable plastic sheet for film. One panel includes vertical slits, in parallel rows. Each row of horizontal slits is longitudinally spaced from adjacent rows; and the slits in alternate rows are aligned in directions transversely of the slits, and the slits in adjacent rows are offset from one another. The other panel includes horizontal slits in parallel rows. Likewise, each row of vertical slits is longitudinally spaced from adjacent rows; and the slits in alternate rows are aligned in directions transversely of the slits, and the slits in adjacent rows are offset from one another.

Note that the slits in the facing panels are substantially perpendicular or normal to one another. It has been found that this structure functions similarly as the solid panel of the prior art to prevent over expansion and deformation of the berry bag, but advantageously it enables full unrestricted ventilation of the enclosed produce.

The foregoing features and advantages of the present invention will be apparent from the following more particular description of the invention. The accompanying drawings, listed hereinbelow, are useful in explaining the invention wherein.

DESCRIPTION OF THE INVENTION

Figure 1:
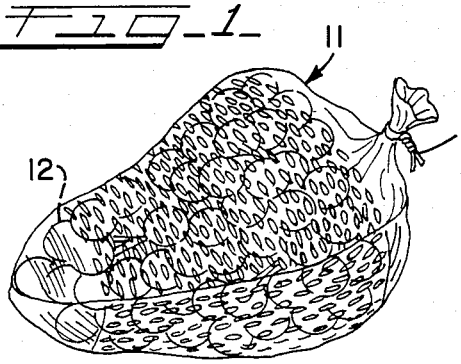
FIG. 1 shows the inventive bag, as it would appear, with produce contained therein.

FIG. 1 shows a package bag 11 in accordance with the invention and containing produce 12, such as grapes, therein. The bag 11 is made from a film of thin pliable and plastic film 14, fabricated as two panels 15 and 16, see FIGS. 2 and 3, and joined such as by heat sealing along the two side edges and the bottom edge. As is obvious, the top edge is initially open to receive the produce and then is closed as by pulling and folding the corners together and tieing the corners one in another as is known, or by using a separate tie as at 17. It will be understood that the bag may be of varying dimensions to accomodate different quantities of produce.

Both of the panels 15 and 16 are slit with a slit pattern as described above with reference to the prior art patent. The top 23 and bottom 24 sections of panel 15 are not slitted and the corresponding sections 25 and 26 of panel 16 are also not slitted. Importantly, note, however, that panel 15 has the slit pattern 21 extending in a horizontal direction, and panel 16 has its slit pattern 22 extending in a vertical direction. With both panels 15 and 16 having a slitted section or pattern 21 and 22, maximum ventilation is provided for the produce contained in bag 11.

In the prior art, one of the panels was not slitted; that is, it comprised a solid sheet hence ventilation to the produce adjacent that panel was limited and unsatisfactory. In said prior art the unslitted panel limited the stretching of the slitted panel as well as of the bag a whole. The unslit panel was also provided so as to support the major portion of the weight of the bag contents. However, as mentioned, the prior art unslit panel interfered with, or limited, the ventilation to the contents of the bag.

Figure 2:
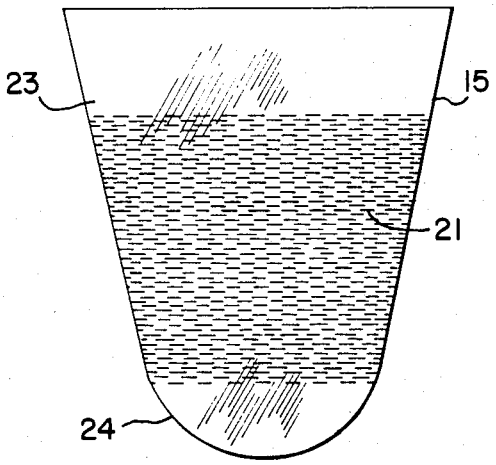
FIG. 2 is a plan view of one panel of the bag of FIG. 1.
Figure 3:
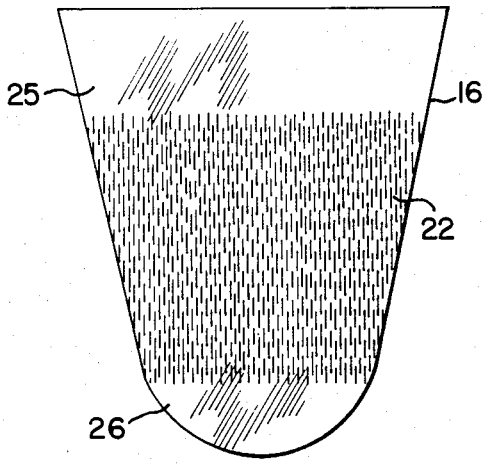
FIG. 3 is a plan view of the opposite panel of the bag of FIG. 1.

The applicant herein discovered that both panels 15 and 16 of bag 11 could be slitted to provide maximum ventilation as well as to provide a bag strong enough to support its contents provided the slit patterns were as shown in FIGS. 2 and 3; that is, substantially normal to one another. The slit pattern 21 of panel 15 will open in a vertical direction to receive the contents and conform closely to the contents placed adjacent thereto, but will not stretch or open in a horizontal direction. Conversely slit pattern 22 of panel 16 will open in a horizontal direction to receive the contents and conform closely to the contents placed adjacent thereto, but will not stretch or open in a vertical direction. By the indicated construction, each of the panels 15 and 16 will cooperate to limit the opening of the slits of the other panel. Thus, the overall bag 11 will not be unduly weakened by the additional slitting and will advantageously provide maximum ventilation to the contents of the bag.

Figure 5:
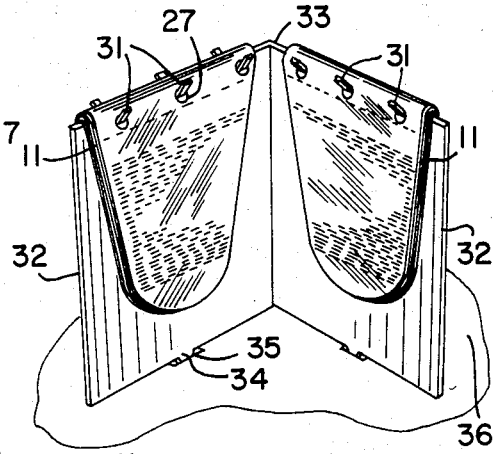
FIG. 5 indicates an adjustable fixture for shipping and mounting the bags for use.
Figure 4:
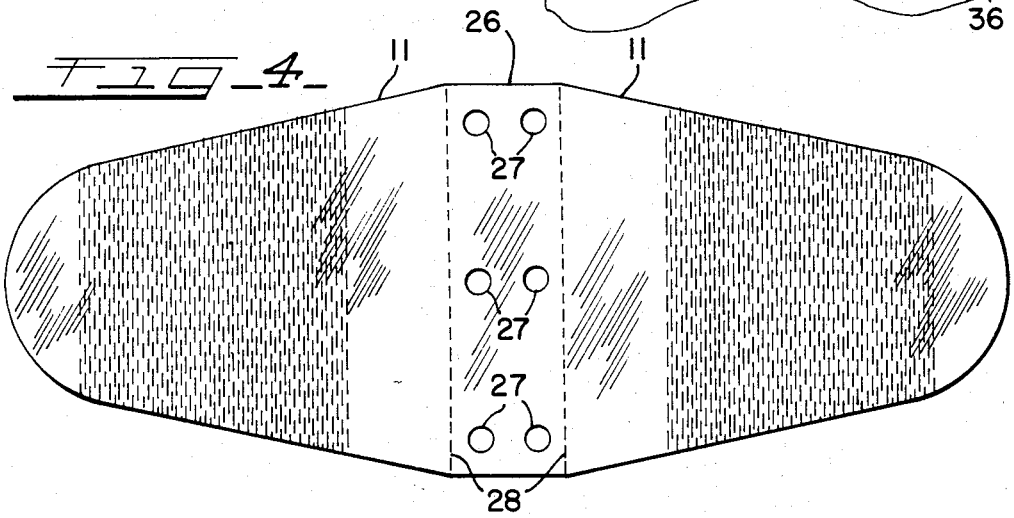
FIG. 4 indicates one method of making the bag of FIG. 1 and indicates two bags joined at the mouth or open end by a support strip having holes for hanging the bags.

One structure and method of making the bags 11 and mounting them for ease of filling is indicating in FIGS. 4 and 5. FIG. 4 shows two bags 11 with a connecting strip 26 formed therebetween and having mounting holes 27 in the strip. Perforations 28 permit the bags 11 to be easily separated from strip 26. In practice the two bags 11 are folded together along the center of the strip and the holes 27 fitted in pegs 31 formed on an adjustable heavy carboard fixture stand 32 of FIG. 5. Fixture 32 and the included bags 11 may be shipped flat and then assembled for operation as by folding the fixture stand 32 to form an angle as at 33. Suitable pegs or flanges 34 on stand 32 inserted into respective holes 35 formed in a base support 36. The user may then reach in and open the facing panel of a bag 11 and insert the produce therein, and then pull and separate the bag 11 from strip 26 along perforation 28. The bag 11 may then be tied as described above.

While the invention has been particularly shown and described with reference to a preferred embodiment therof, it will be understood by those skilled in the art that various changes in form and details may be made therein without departing from the spirit and scope of the invention.

What is claimed is:

1. Packaging means comprising:

a bag comprised of at least two panels of pliable film having side and bottom edges joined to form a bag with a normally openable upper end and a normally closed lower end; one of said panels having rows of spaced slits extending in a first direction, the slits in alternate rows being approximately aligned in a first transverse direction, and the slits in adjacent rows being offset lengthwise of the rows whereby said panel portion is adapted to stretch in said first transverse direction; and, another of said panels having rows of spaced slits extending in a second direction transversely related to said first direction, the slits in alternate rows being approximately aligned transversely of said second direction and the slits in adjacent rows being offset lengthwise of the rows of said second direction, said other panel thereby being stretchable transversely to said second direction, whereby said panels cooperate to provide a ventilated bag while limiting the stretching of the bag.

2. A packaging means, comprising:

a bag formed of at least two panels of a pliable film; said bag having an openable upper end and a closed lower end;

a portion of one of said panels having generally straight and parallel rows of spaced slits extending in a first direction, the slits in alternate rows being approximately aligned transversely to the direction of the rows and the slits in adjacent rows being offset lengthwise of the rows, whereby said panel portion is adapted to stretch transversely to said first direction;

a portion of another of said panels having generally straight and parallel rows of spaced slits extending in a second direction substantially perpendicularly to said first direction, the slits in alternate rows being approximately aligned transversely to the second direction of the rows, and the slits in adjacent rows being offset lengthwise of the rows, whereby said second panel portion is adapted to stretch transversely to said second direction.

3. A packaging means as in claim 1 wherein the slits adjacent the lower end of said bag are spaced a distance from said lower end and the slits adjacent the upper end are spaced a distance from said upper end.

4. Packaging means comprising:

a bag composed of two similarly shaped panels of pliable film having side and bottom edges joined to form a bag with a normally openable upper end and a closed lower end;

one of said panels having normally vertically extending generally straight and parallel rows of spaced slits, the slits in alternate rows being approximately aligned in a transverse direction of the rows and the slits in adjacent rows being offset lengthwise of the rows, whereby said panel is adapted to stretch in said transverse direction; and the second of said panels having normally horizontally extending generally straight and parallel rows of spaced slits transverse to said slits in said one panel, the slits in alternate rows being approximately aligned in a transverse direction of the rows in said second panel, and the slits in adjacent rows being offset lengthwise of the rows, whereby said second panel is adapted to stretch in said transverse direction of the rows in said second panel.

* * * * *